US006516848B1

(12) United States Patent
Provitola

(10) Patent No.: US 6,516,848 B1
(45) Date of Patent: Feb. 11, 2003

(54) TOROIDAL WHEEL

(76) Inventor: Anthony Italo Provitola, P.O. Box 2855, DeLand, FL (US) 32721-2855

( * ) Notice: Subject to any disclaimer, the term of this patent is extended or adjusted under 35 U.S.C. 154(b) by 38 days.

(21) Appl. No.: 09/314,267

(22) Filed: May 18, 1999

(51) Int. Cl.[7] ..... B60C 7/00
(52) U.S. Cl. ..... 152/285
(58) Field of Search ..... 301/1, 5.1, 60; 305/6, 7, 185, 166, 167, 170, 15, 20; 180/221, 907; 152/5, 13, 284, 285, 286, 287, 92, 1, 11, 12

(56) References Cited

U.S. PATENT DOCUMENTS 656,111 A * 8/1900 Hall ..... 301/1
919,826 A * 4/1909 Clausen ..... 152/284
1,001,715 A * 8/1911 Wall ..... 152/284
1,049,254 A * 12/1912 McKillop ..... 301/5.1
1,237,494 A * 8/1917 Ellwood ..... 301/5.1
1,257,318 A * 2/1918 Coats ..... 301/5.1
1,294,228 A * 2/1919 Bontoft ..... 301/5.1
1,416,253 A * 5/1922 Bobek ..... 152/284
1,419,555 A * 6/1922 Garwood ..... 305/7
1,710,215 A * 4/1929 Horvath ..... 152/284
2,451,965 A * 10/1948 Longenecker ..... 180/221
2,574,824 A * 11/1951 Garelli ..... 180/221
4,011,919 A * 3/1977 Groeger ..... 305/6
4,360,222 A * 11/1982 Fisher ..... 301/1
4,407,550 A * 10/1983 Lapsys ..... 305/166
4,957,332 A 9/1990 Batelaan
5,188,192 A * 2/1993 Sbarro ..... 180/221
5,383,715 A * 1/1995 Homma et al. ..... 301/5.1
5,427,443 A * 6/1995 Muramatsu et al. ..... 305/6
5,720,529 A 2/1998 Barron
5,735,363 A * 4/1998 Horovitz et al. ..... 180/221
5,778,998 A * 7/1998 Shih ..... 180/221

* cited by examiner

*Primary Examiner*—S. Joseph Morano
*Assistant Examiner*—Long Bao Nguyen

(57) ABSTRACT

The toroidal wheel is a self-supporting framework of connected torsion elements, which is not supported by any spokes, hub, or wheel disk. The toroidal wheel rotates in direct contact with the underlying surface on and against which it is operated, and may be operated in a mount/drive. The object of the toroidal wheel is to provide conventional wheel function and ancillary uses, such as gears and other rotating devices, plus additional uses precluded or made impractical by the central hub of the conventional wheel.

20 Claims, 11 Drawing Sheets

TOROIDAL WHEEL

CROSS-REFERENCE TO RELATED APPLICATIONS

U.S. patent application Ser. Nos. 09/276665 and 09/276666.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

The present invention is a toroidal wheel which is a self-supporting framework of connected torsion elements.

The concept of the wheel has remained unchanged for centuries: a circular device with a central hub which operates by rotation about the hub, which shall hereinafter be referred to as the "conventional wheel", or simply as the "wheel", from which the term "toroidal wheel" may be distinguished. The centuries-unchanged means for utilization of the wheel is twofold: to allow the wheel to rotate freely on a spindle inserted into its hub; or to fixedly attach the wheel at its hub to an axle which turns with the wheel, or vice versa, so that the axle and wheel rotate together. Thus the device of the wheel and the means of rotation are necessarily integral. The object of the conventional wheel is to have the outer edge of the wheel, usually referred to as the rim, remain relatively motionless at its point of contact with the underlying surface while the wheel is in rotational and translational motion with respect to the underlying surface.

The concept of the wheel may be extended by the present invention. The object of the toroidal wheel is to provide conventional wheel function and ancillary uses, such as gears and other rotating devices, plus additional uses precluded or made impractical by the central hub of the conventional wheel. Because the toroidal wheel has no central hub, the toroidal wheel requires other means for rotation, an example of which is a mount/drive, which holds one or more rollers in contact with the toroidal wheel within and without the ring of the toroidal tube. The rollers of a mount/drive hold the toroidal wheel in position while allowing it to rotate freely, or otherwise regulate its rotational motion by driving and/or braking it.

The present invention has elements that may be considered to be covered generally by class 152, resilient tires and wheels, and may be considered under the subclasses 1–13 covering spring wheels.

BRIEF SUMMARY OF THE INVENTION

The present invention is a toroidal wheel, having a self supporting framework of torsion elements connected in a toroidal shape, but without a central hub.

The object of the toroidal wheel is to provide conventional wheel function and ancillary uses, such as gears and other rotating devices, plus additional uses precluded or made impractical by the central hub of the conventional wheel.

A mount/drive is a series of rollers within and without the ring of the toroidal tube, which are in contact with a toroidal wheel, and which hold the toroidal wheel in position while allowing it to rotate freely and/or driving it. Mount/drives may be configured to mount and/or drive two or more toroidal wheels, or configured with two chassis joined by shafts for rollers, so that one or more toroidal wheels may be mounted and/or driven between the chassis. Mount/drives may be friction drives or mount/drives for toroidal gears or for the framework toroidal wheel body; the difference between such mount/drives and the friction mount/drive being the structure of the rollers. The mount/drives may be used to support and drive vehicles. Flexible gears, which are toroidal wheels covered with a gear-toothed sheathing, may also be run against each other using mount/drives with gear-toothed rollers.

Toroidal wheel operation may also be cushioned like that of a pneumatic tire by integrating wheel support elements in the framework of the toroidal wheel.

DETAILED DESCRIPTION OF THE INVENTION

Figure 5:
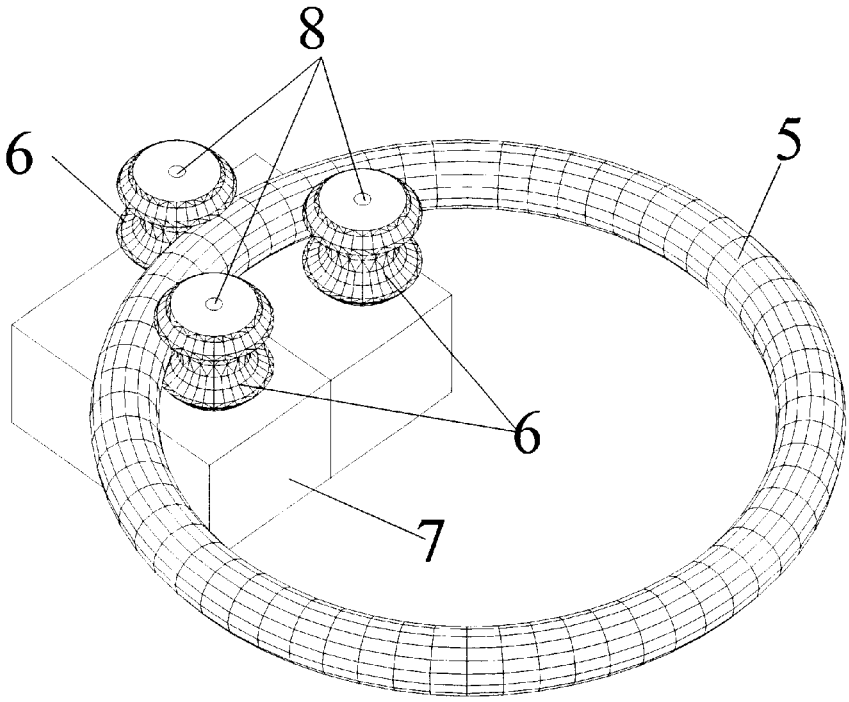
FIG. 5 is a diagrammatic perspective view of a first-type of mount/drive with a toroidal wheel mounted.
Figure 6:
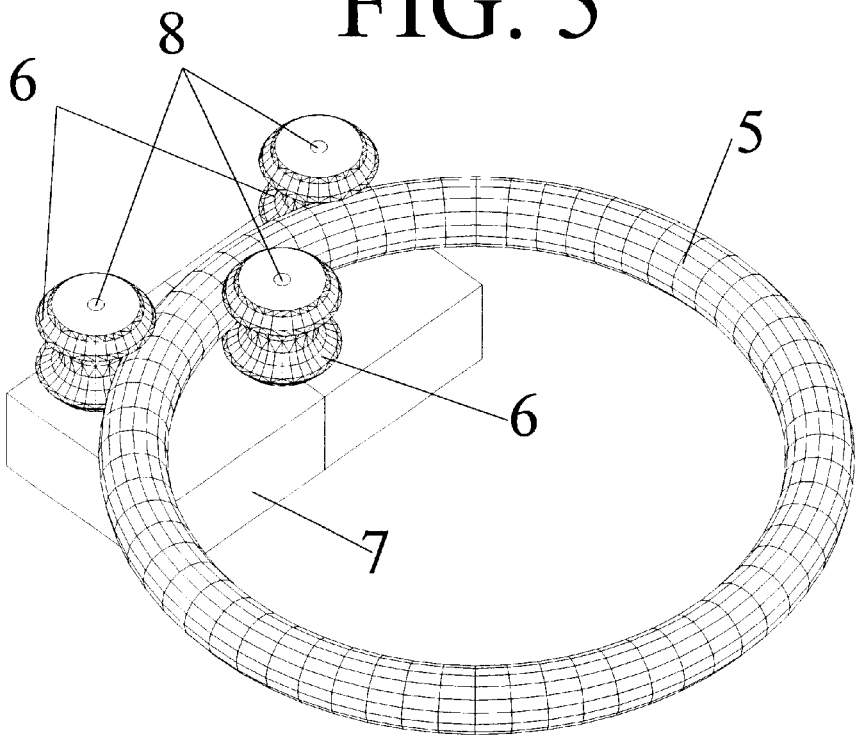
FIG. 6 is a diagrammatic perspective view of a second-type mount/drive with a toroidal wheel mounted.

The present invention is a toroidal wheel having a self-supporting framework of torsion elements connected in a toroidal shape, but without a central hub, and rotates in contact with the underlying surface or other wheels or rollers against and on which it is operated. A toroidal wheel is operated in a mount/drive, an assembly in which the toroidal wheel is mounted so as to be able to rotate, and which drives the toroidal wheel in rotation, examples of which are shown in FIGS. 5 and 6. The term mount/drive shall include the entity which shall hereinafter be referred to as the simple mount, which is a mount/drive that does not transfer any motive power to the toroidal wheel. Although a simple mount allows free rotation of the toroidal wheel which is mounted therein, it may also provide a limitation on such rotational motion, such as braking. Therefore the term mount/drive includes an entity in which a toroidal wheel may be mounted for and driven in rotation, and an entity in which a toroidal wheel is only mounted for rotation, but not driven.

The object of the toroidal wheel is to provide conventional wheel function and ancillary uses, such as gears and other rotating devices, plus additional uses precluded or made impractical by the central hub of the conventional wheel.

Figure 1:
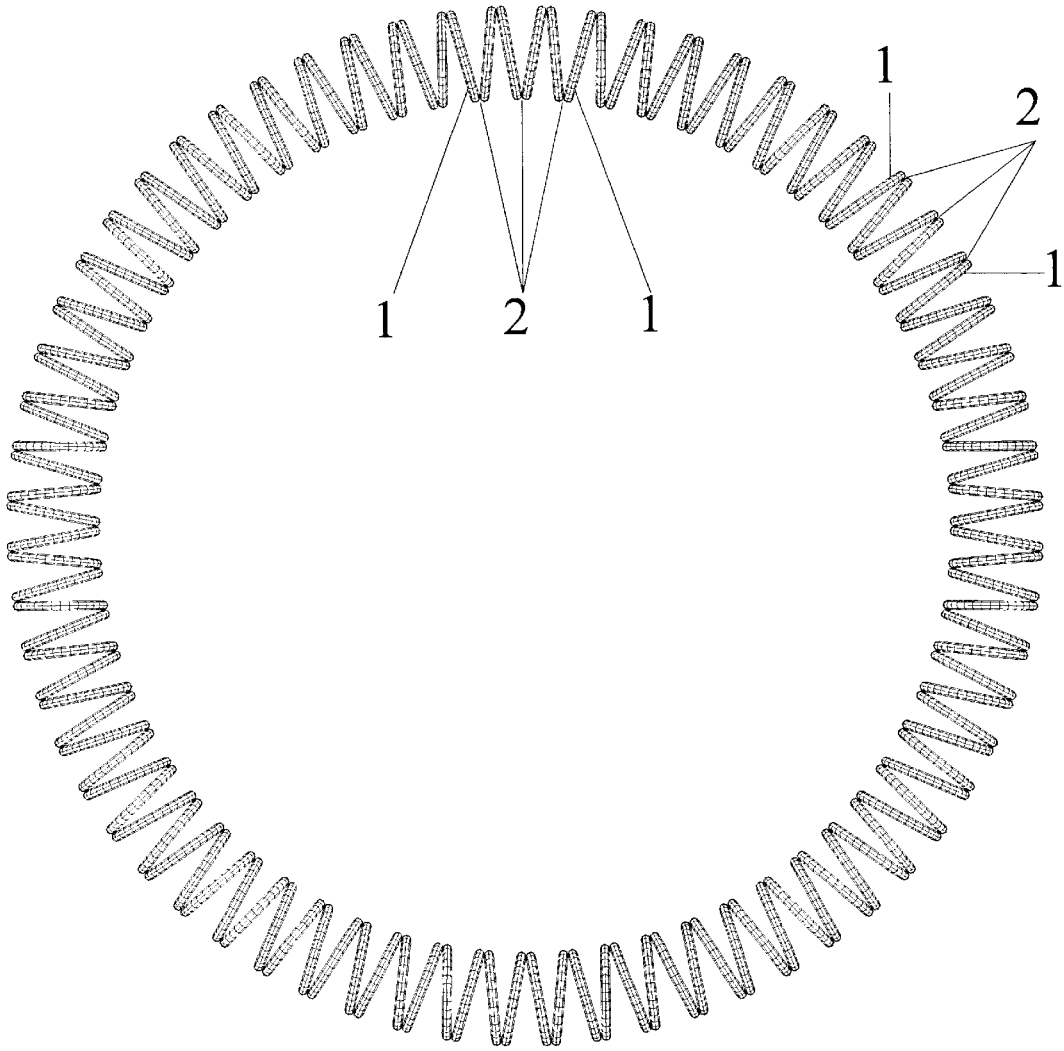
FIG. 1 is a side view of a toroidal wheel framework.
Figure 2:
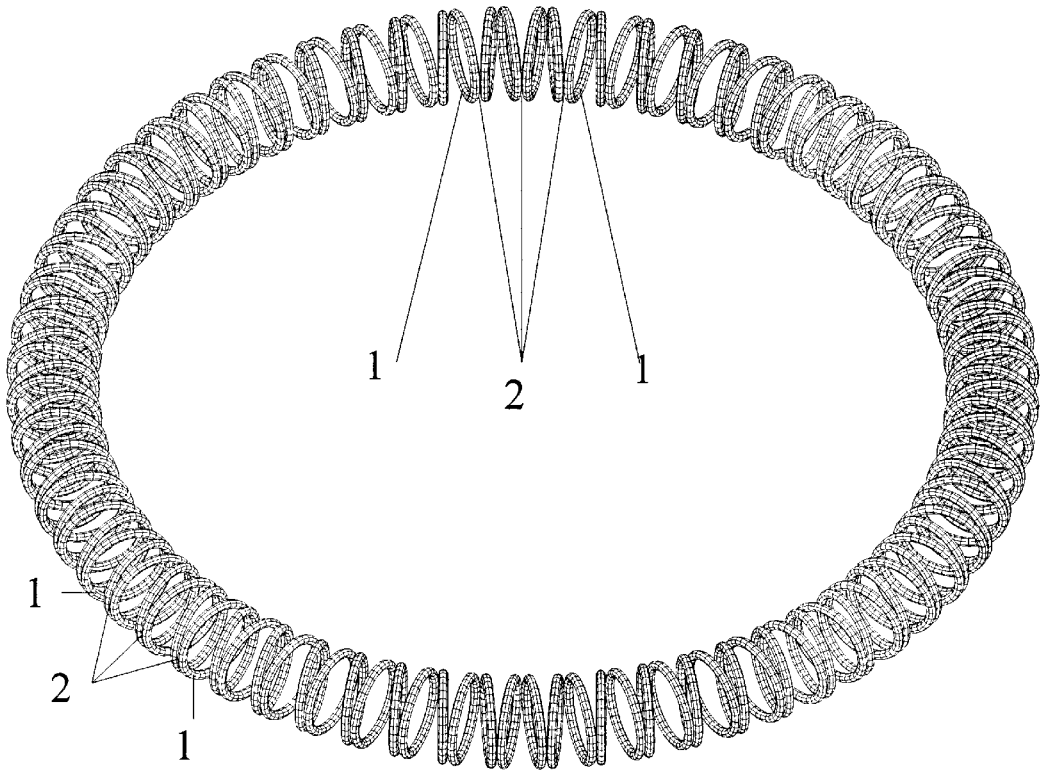
FIG. 2 is a perspective view of the framework shown in FIG. 1.

The structure of the toroidal wheel is a framework of connected 2 torsion elements 1 as shown in FIGS. 1 and 2. Such a framework is an application of the structural system which is the subject of U.S. patent application Ser. No. 09/276666, Structural System of Torsion Elements and Method of Construction Therewith, by the present applicant. Application Ser. No. 09/276666 discloses a "structural system which employs 'torsion elements' which are connected to form structures" of which a "principle of the invention is the transmission of torsional loads by the connection of 'torsion elements'" the term "torsion element" meaning "a structural element that functions with torsion as its principal load bearing mode". As stated in that Application "torsion elements use the torsional strength of materials and have the capacity to bear the torsion loads distributed to them by the connections of the structural system of which they are a part". Also as stated in that Application "torsion elements may be connected by any means that does not permit unwanted movement in the connection" and "may be any type of joining, such as welding, gluing, fusing, or with the use of fasteners, such as pins, screws and clamps". The toroidal wheel with a framework of connected torsion elements evenly distributes the compression and/or tension load on any part of the toroidal wheel to all of the torsion elements of the framework, and is thus self-supporting. Such a framework may be constructed to be flexible in order to conform to irregularities of surfaces. The toroidal wheel framework shown in FIGS. 1 and 2 may also be an application of the structural system which is the subject of U.S. patent application Ser. No. 09/276665, Structural System of Toroidal Elements and Method of Construction Therewith, also by the present applicant. In advanced embodiments of the invention the toroidal wheel need not be circular, and its shape continuously controlled by internal actuators to conform to the drive, all in accordance with the structural systems disclosed in said U.S. Patent Applications.

Figure 3:
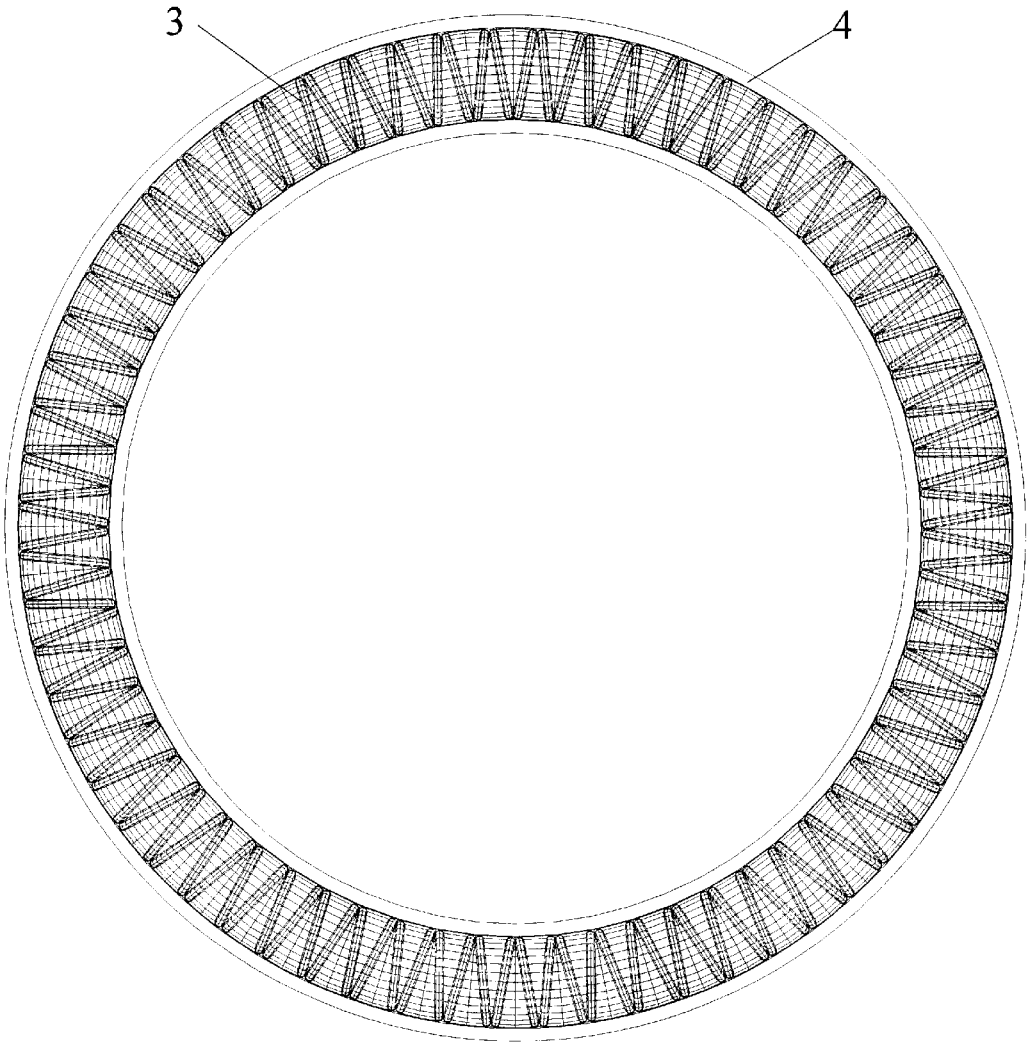
FIG. 3 is a side cutaway view of the framework shown in FIG. 1 sheathed in a casing.
Figure 4:
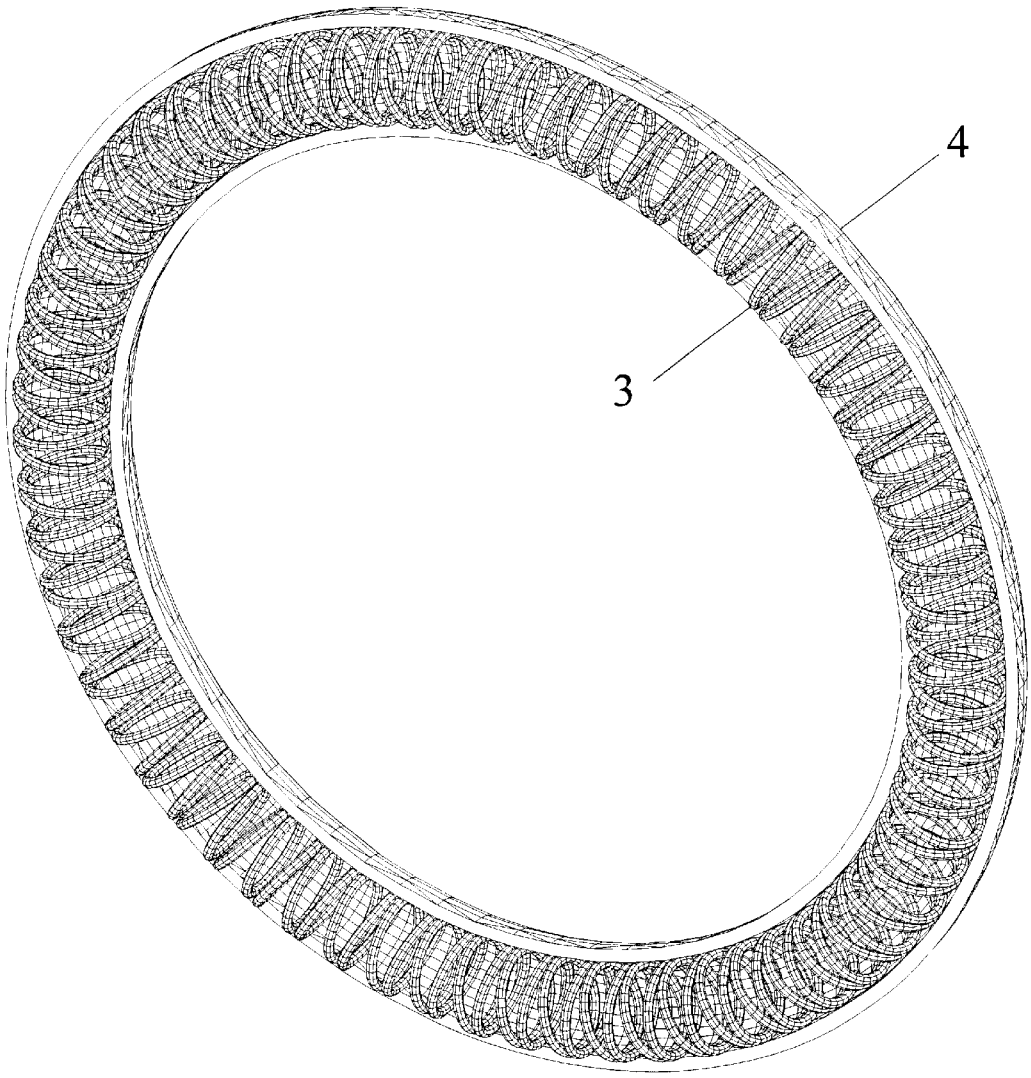
FIG. 4 is a perspective cutaway view of the toroidal wheel shown in FIG. 3.
Figure 9:
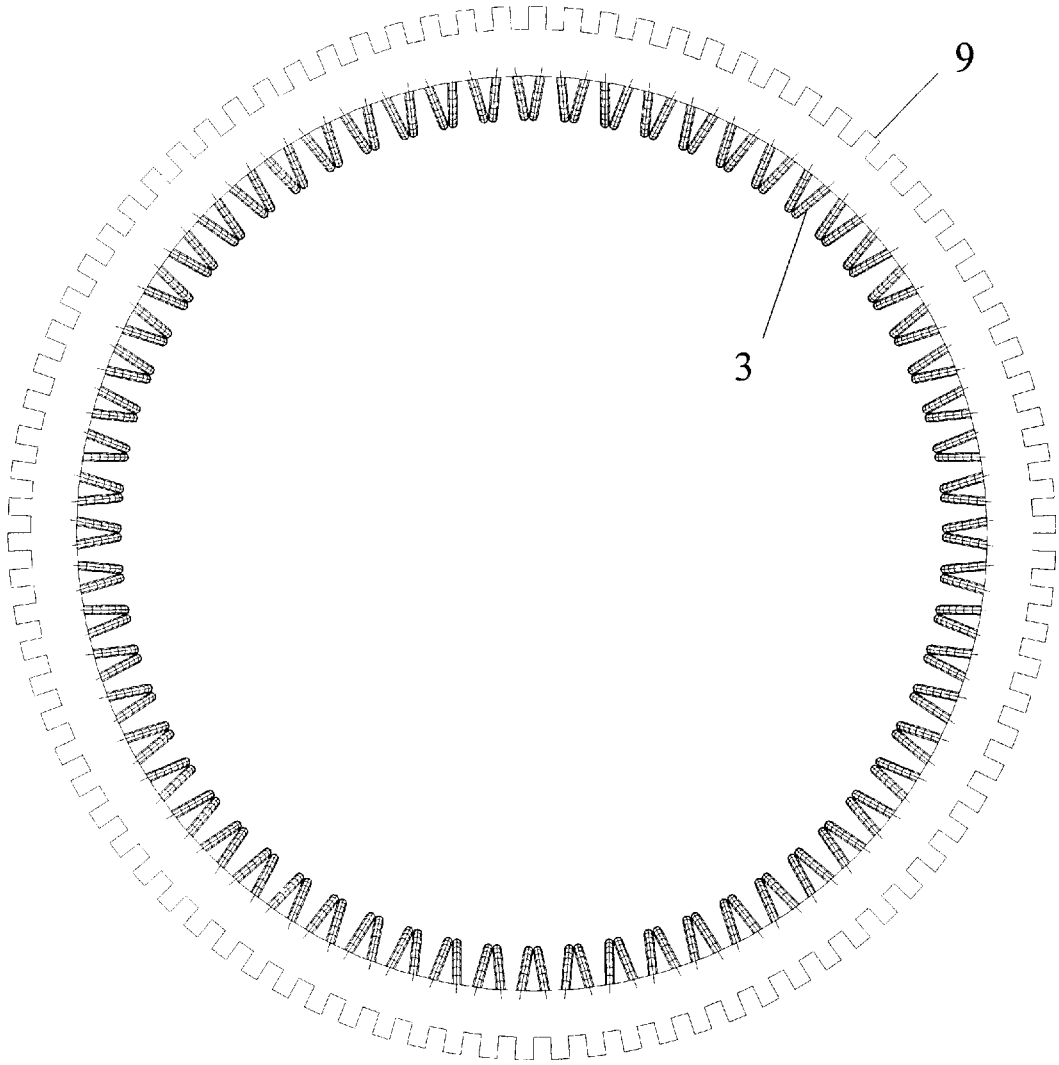
FIG. 9 is a side view of a toroidal gear.
Figure 10:
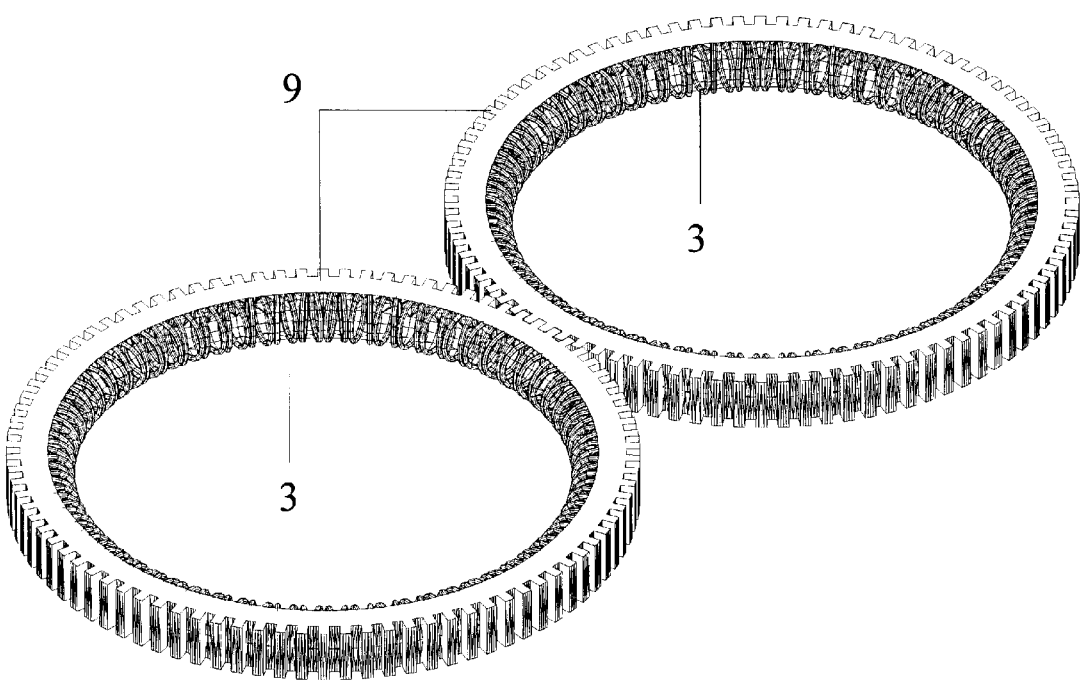
FIG. 10 is a perspective view of two of the gears shown in FIG. 9 which are enmeshed.

The toroidal wheel framework 3 may be used directly as a toroidal wheel, or sheathed in a casing 4 as shown in FIGS. 3 and 4, which may be a gear casing 9 as shown in FIGS. 9 and 10. Similar to a paddle wheel, the framework toroidal wheel can operate on mud, sand, snow, or other loose material constituting the underlying surface. All of the types of toroidal wheel 5 can be used with mount/drives as shown in FIGS. 5 and 6 with appropriately surfaced rollers 6.

A mount/drive is a series of rollers 6 in contact with the toroidal wheel 5 inside and outside of the ring of the toroidal wheel 5, the purpose of such rollers 6 being to hold the toroidal wheel 5 in position while driving it and/or allowing it to rotate freely. The examples of the mount/drives which are shown in FIGS. 5 and 6 have a chassis 7, which may be a framework, solid block, or box-like structure, with at least three shafts 8 mounted on at least one side of the chassis 7 with the shafts 8 fixed or bearing-mounted to rotate. Each of the shafts 8 may have at least one roller 6 mounted thereon, which is either fixed to turn with the shaft 8, if the shaft 8 is mounted with a bearing to the chassis 7, or bearing-mounted on a fixed non-rotating shaft. Each of the rollers 6 may be free to rotate or each may be driven by a source of rotational motive power. A roller 6 which is free to rotate, but does not provide rotational motive power to the toroidal wheel, may hereinafter be referred to as a guide roller. A roller 6 which provides rotational motive power to the toroidal wheel may hereinafter be referred to as a drive roller. Where all of the rollers 6 of a mount/drive are free to rotate, the mount/drive is a simple mount. Such a simple mount may be referred to hereinafter as a mount. Otherwise the term mount/drive will be used where at least one of the rollers 6 thereon is driven by motive power. The shafts 8 need not be perpendicular to the chassis, so long as the rollers 6 mounted thereon hold the toroidal wheel 5 in a position allowing it to rotate with the rollers 6.

As seen from FIG. 5 the chassis has three rollers 6, one outside the ring of the toroidal wheel 5 and two inside the ring, with all rollers 6 in contact with the toroidal wheel 5, thus holding it in a position whereby such contact can be maintained with all the rollers 6 only if the toroidal wheel 5 is inflexible. In the example of the mount/drive in FIG. 5, if the toroidal wheel 5 is flexible, compression of the toroidal wheel 5 from the position on the toroidal wheel 5 opposite the mount/drive could cause the inner two rollers 6 to loose contact with the toroidal wheel 5, and tension on the toroidal wheel 5 from the same position would further press the toroidal wheel 5 into contact with the rollers 6.

In the case of the mount/drive shown in FIG. 6, the mount/drive has one roller 6 inside the ring of the toroidal wheel 5 and two outside the ring, with all rollers 6 in contact with the toroidal wheel 5, thus holding it in a position whereby such contact can be maintained with all the rollers 6 only if the toroidal wheel 5 is inflexible. In the example of the mount/drive in FIG. 6, if the toroidal wheel 5 is flexible, compression of the toroidal wheel 5 from the position on the toroidal wheel 5 opposite the mount/drive would further press the toroidal wheel 5 into contact with the rollers 6, and tension on the toroidal wheel 5 from the same position could cause the outer two rollers 6 to loose contact with the toroidal wheel 5.

The application of the invention determines whether a toroidal wheel 5 should be flexible or inflexible, and, if flexible, the number of rollers 6 to be used on each chassis 7 in order to maintain the required contact between the rollers 6 and the toroidal wheel 5. Four rollers are sufficient to maintain such contact when a toroidal wheel is flexible, with considerations of symmetry and the required amount of contact area between driving rollers and the toroidal wheel governing any necessity for more.

In the case of a flexible toroidal wheel three rollers are adequate to hold the toroidal wheel in position and maintain contact with the toroidal wheel, if the shafts on which the rollers are mounted are moveable so as to compensate for the change in shape of the toroidal wheel. This can be accomplished by spring loading or otherwise actuating the shafts to force the rollers against the toroidal wheel in order to maintain the required contact for the operation of the mount/drive.

Mount/drives may be configured so that more than one toroidal wheel may be mounted using shafts having more than one roller. Mount/drives may also be configured with two chassis joined by shafts with rollers, so that one or more toroidal wheels may be mounted and/or driven between such chassis.

The mount/drives as depicted in FIGS. 5 and 6 appear to have relatively smooth rollers 6 in contact with a relatively smooth toroidal wheel 5, and illustrate a mount/drive in which friction between rollers 6 and the toroidal wheel 5 is the means for driving the toroidal wheel 5 with the rollers 6, and vice versa. However, the mount/drives shown in FIGS. 5 and 6 may also be understood as diagrammatic illustrations of mount/drives for toroidal gears, as shown in FIG. 9, the difference between such mount/drives and the friction mount/drive being the structure of the rollers 6. The drive rollers for a toroidal gear would also be gears that mesh with the toroidal gear. The mount/drives shown may have any combination of drive rollers and guide rollers appropriate to the application. It is also contemplated that a toroidal gear or toroidal wheel may also be driven by rollers within the ring which are in contact therewith.

Figure 7:
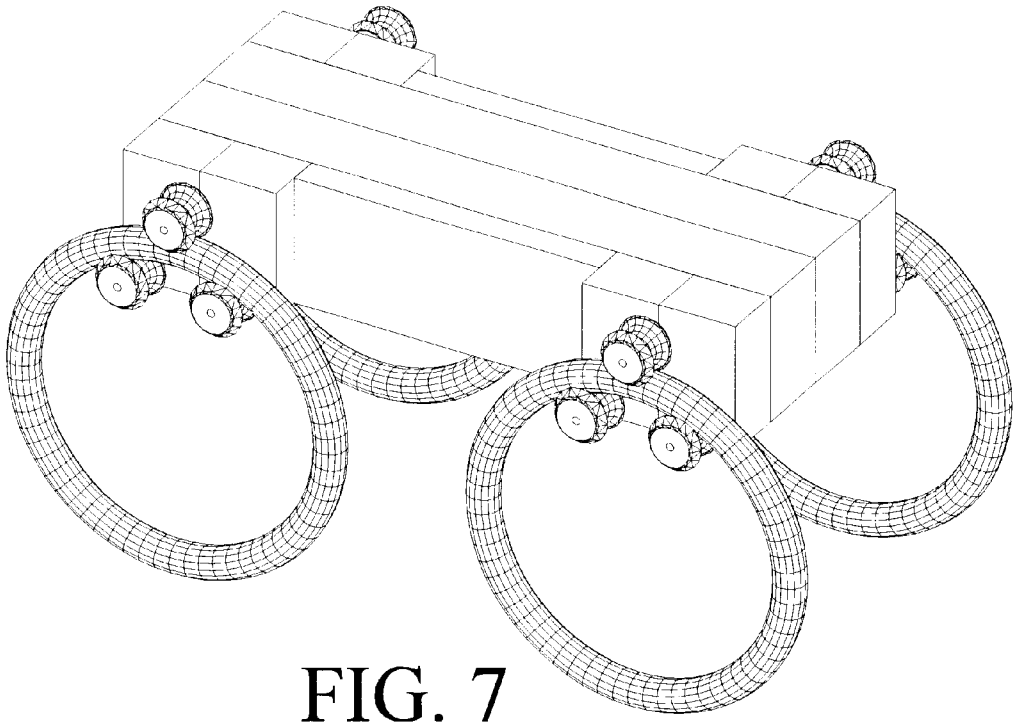
FIG. 7 is a diagrammatic perspective view of vehicular mounting of four toroidal wheels on a chassis with mount/drives as shown in FIG. 5
Figure 8:
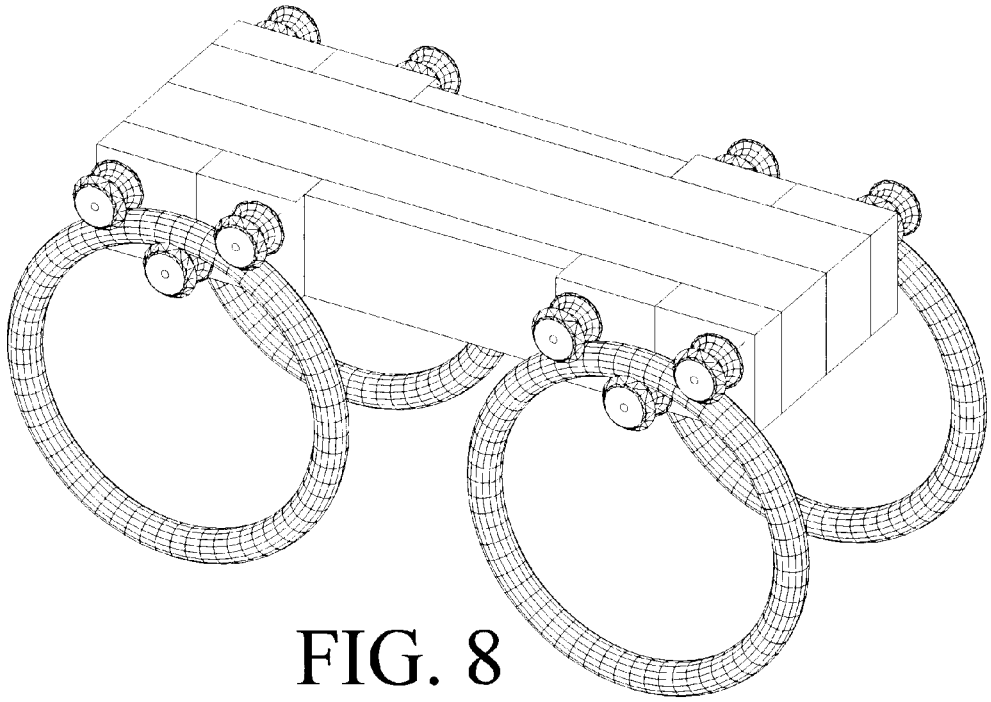
FIG. 8 is a diagrammatic perspective view of vehicular mounting of four toroidal wheels on a chassis with mount/drives as shown in FIG. 6.

The friction drives which are shown in FIGS. 5 and 6 may be used to support and drive vehicles as shown in FIGS. 7 and 8. Flexible gears as shown in FIG. 9 may also be run against each other as shown in FIG. 10 using mount/drives with gear-toothed rollers.

Figure 11:
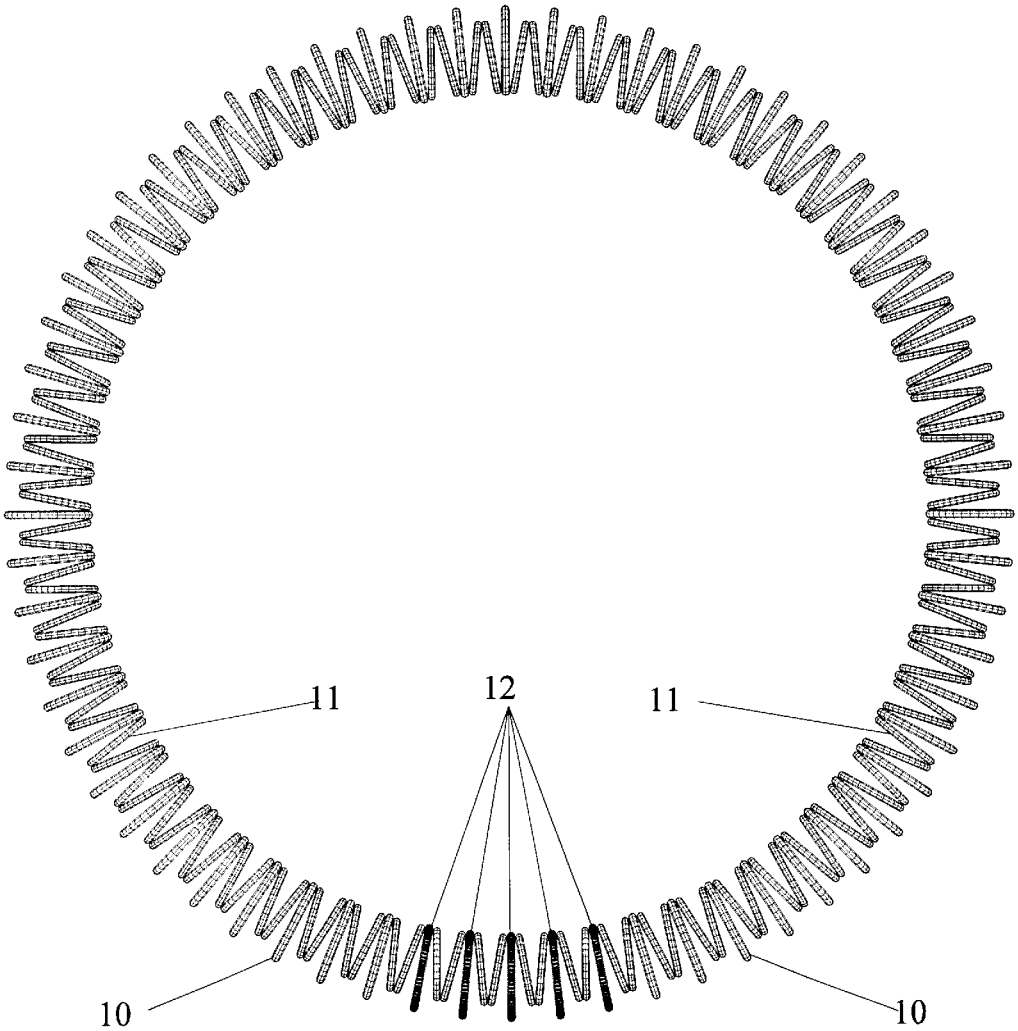
FIG. 11 is a side view of a framework of a toroidal wheel with integrated wheel cushion support elements (the lowest five of which are as shown in detail with the rest being shown diagrammatically).
Figure 12:
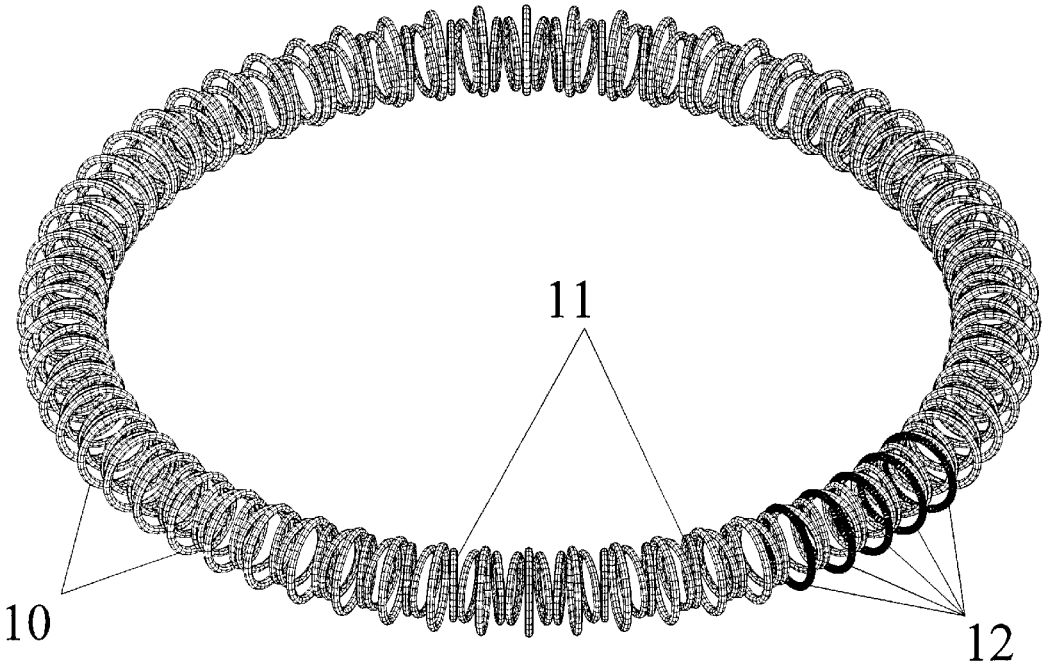
FIG. 12 is a perspective view of the framework shown in FIG. 11.
Figure 13:
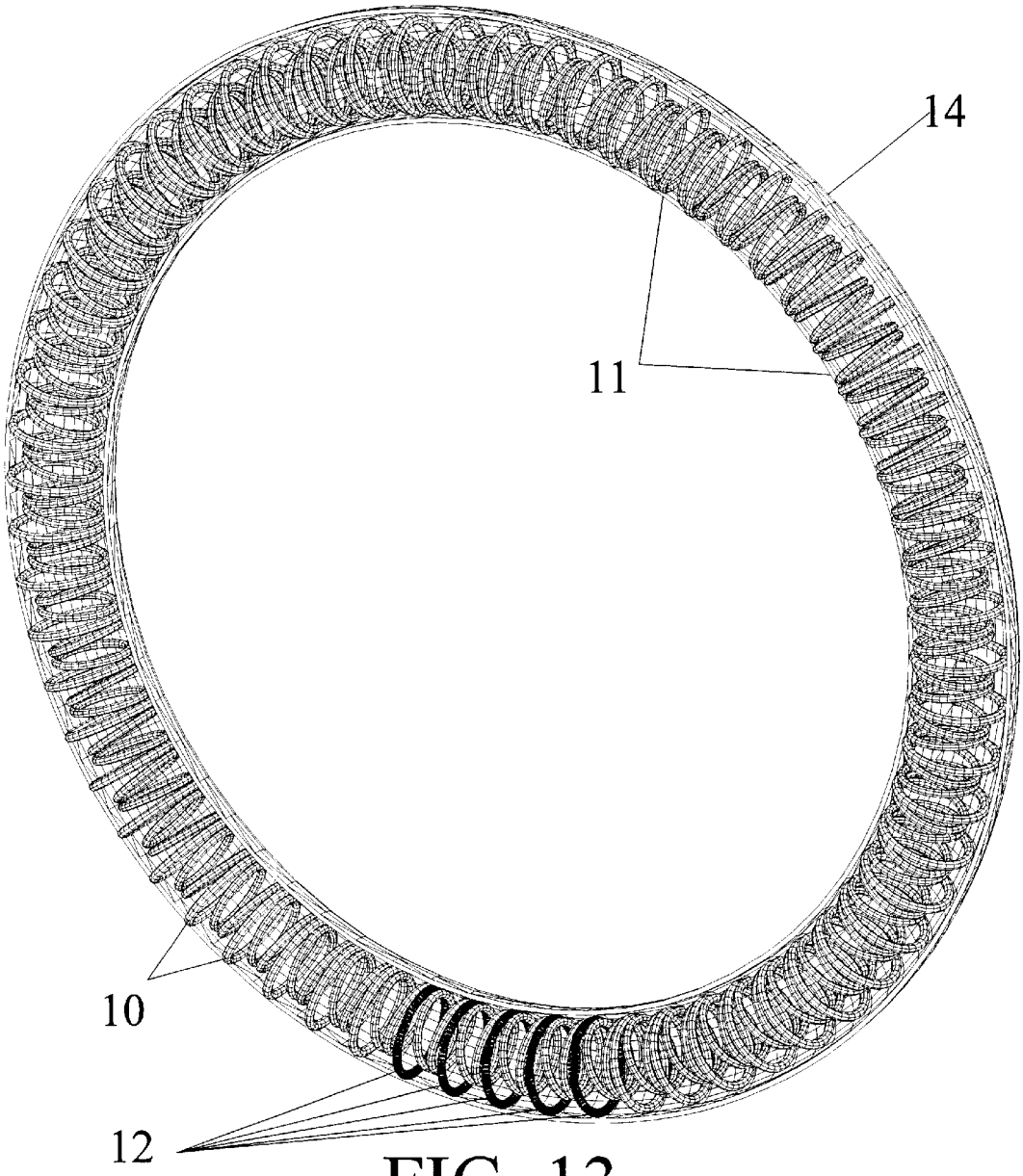
FIG. 13 is a second perspective view of the framework shown in FIG. 11 sheathed in a casing.

Toroidal wheel operation may also be cushioned like that of a pneumatic tire by integrating wheel support elements 10 in the framework 11, as shown FIGS. 11 and 12. Wheel support elements 10 may be toroidal elements that compress elastically, and may be of the same general structure as the toroidal wheel framework shown in FIGS. 1 and 2, such as the lowest five 12 of such elements in FIGS. 11 and 12. The preferred embodiment of a framework toroidal wheel 11 cushioned by wheel support elements 10 is with a casing 14 for operation on relatively smooth surfaces as shown in FIG. 13.

While the invention has been disclosed in connection with a preferred embodiment, it will be understood that there is no intention to limit the invention to the particular embodiment shown, but it is intended to cover the various alternative and equivalent constructions included within the spirit and scope of the appended claims.

What I claim as my invention is:

1. A toroidal wheel comprising a toroidal framework of torsion elements, further comprising (a) a plurality of torsion elements which function with torsion as the principal load bearing mode; and (b) by means for connecting the torsion elements so that the torsional load on one of the torsion elements is transmitted to one or more of the other of the torsion elements to which said one of the torsion elements is connected;

so that the toroidal framework is self-supporting.

2. The toroidal wheel of claim 1 wherein the toroidal framework of torsion elements is not supported by any spokes, hub, or wheel disk.

3. The toroidal wheel of claim 1 wherein the shape of the toroidal framework of torsion elements is controlled by internal actuators.

4. The toroidal wheel of claim 1 wherein the shape of the toroidal framework of torsion elements is controlled by one or more actuators in the connections between the torsion elements of the toroidal wheel framework, said actuators being able to change the angular relationship between connected torsion elements.

5. The toroidal wheel of claim 1 wherein the toroidal framework of torsion elements is sheathed in a casing with a friction surface.

6. The toroidal wheel of claim 1 wherein the toroidal framework of torsion elements is sheathed in a casing with a surface which has gear teeth.

7. The toroidal wheel of claim 1 wherein the toroidal wheel is operated in a mount/drive.

8. The toroidal wheel of claim 1 further comprising support elements integrated with the toroidal framework of torsion elements.

9. The toroidal wheel of claim 1 further comprising a means for operating the toroidal wheel so that it can rotate in contact with a surface against which it is operated.

10. The toroidal wheel of claim 1 further comprising a means for driving the toroidal wheel in rotation in contact with a surface against which it is operated.

11. A toroidal wheel comprising a toroidal framework of torsion elements, further comprising (a) a plurality of torsion elements which function with torsion as the principal load bearing mode; and (b) means for connecting the torsion elements so that the torsional load on one of the torsion elements is transmitted to one or more of the other of the torsion elements to which said one of the torsion elements is connected;

wherein the toroidal framework is not supported by any spokes, hub, or wheel disk.

12. The toroidal wheel of claim 11 wherein the toroidal framework of torsion elements is self-supporting.

13. The toroidal wheel of claim 11 wherein the shape of the toroidal framework of torsion elements is controlled by internal actuators.

14. The toroidal wheel of claim 11 wherein the shape of the toroidal framework of torsion elements is controlled by one or more actuators in the connections between the torsion elements of the toroidal wheel framework, said actuators being able to change the angular relationship between connected torsion elements.

15. The toroidal wheel of claim 11 wherein the toroidal framework of torsion elements is sheathed in a casing with a friction surface.

16. The toroidal wheel of claim 11 wherein the toroidal framework of torsion elements is sheathed in a casing with a surface which has gear teeth.

17. A toroidal wheel comprising a toroidal framework of torsion elements, further comprising:

(a) a plurality of torsion elements which function with torsion as the principal load bearing mode; and (b) means for connecting the torsion elements so that the torsional load on one of the torsion elements is transmitted to one or more of the other the torsion elements to which said one of the torsion elements is connected;

wherein the toroidal framework is self-supporting and is not supported by any spokes, hub, or wheel disk.

18. The toroidal wheel of claim 17 wherein the shape of the toroidal framework of torsion elements is controlled by internal actuators.

19. The toroidal wheel of claim 17 wherein the shape of the toroidal framework of torsion elements is controlled by one or more actuators in the connections between the torsion elements of the toroidal wheel framework, said actuators being able to change the angular relationship between connected torsion elements.

20. The toroidal wheel of claim 17 wherein the toroidal framework of torsion elements is sheathed in a casing with a friction surface.

* * * * *